US007342560B2

(12) United States Patent
Yuki et al.

(10) Patent No.: US 7,342,560 B2
(45) Date of Patent: Mar. 11, 2008

(54) VOLTAGE CURRENT CONVERSION DEVICE AND LIGHT EMITTING DEVICE

(75) Inventors: Osamu Yuki, Tokyo (JP); Shigeki Kondo, Hiratsuka (JP); Yoshinori Nakajima, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 457 days.

(21) Appl. No.: 11/092,858

(22) Filed: Mar. 30, 2005

(65) Prior Publication Data

US 2005/0248372 A1 Nov. 10, 2005

(30) Foreign Application Priority Data

Apr. 1, 2004 (JP) ..... 2004-109102

(51) Int. Cl.
*G09G 3/32* (2006.01)
*G09G 3/30* (2006.01)

(52) U.S. Cl. ..... 345/82; 345/76; 345/211; 315/169.3

(58) Field of Classification Search ..... 345/76–83, 345/36, 39, 44–46, 211; 313/463; 315/169.3
See application file for complete search history.

(56) References Cited

U.S. PATENT DOCUMENTS 6,229,506 B1 5/2001 Dawson et al.
6,411,162 B2 * 6/2002 Minamizaki et al. ..... 330/255
6,577,302 B2 6/2003 Hunter et al.
6,657,394 B2 12/2003 Nasman ..... 315/111.21
6,670,773 B2 12/2003 Nakamura et al. ..... 315/169.3
6,777,888 B2 8/2004 Kondo ..... 315/169.3
6,812,768 B2 * 11/2004 Kawasaki et al. ..... 327/333
6,870,553 B2 3/2005 Kondo et al. ..... 345/690
6,992,663 B2 1/2006 Nakamura et al. ..... 345/204
7,126,565 B2 * 10/2006 Kawasaki et al. ..... 345/76
2004/0183752 A1 * 9/2004 Kawasaki et al. ..... 345/20
2006/0119552 A1 6/2006 Yumoto

FOREIGN PATENT DOCUMENTS

JP 2-188019 A 7/1990
JP 7-283708 A 10/1995
JP 2002-40074 2/2002
JP 2002-514320 5/2002
JP 2003-195808 A 7/2003
JP 2003-529805 10/2003
WO 02/39420 A1 5/2002

* cited by examiner

*Primary Examiner*—Jimmy H. Nguyen
(74) *Attorney, Agent, or Firm*—Fitzpatrick, Cella, Harper & Scinto

(57) ABSTRACT

In case an input voltage is zero, to sufficiently shut off an output current, a source side of a first transistor T1 is connected to the drains of fourth and fifth transistors T4 and T5, and during a self-bias period of the first transistor T1, a source of the first transistor T1 is made a second potential through the fourth transistor T4, and in a gate potential setting period of the first transistor T1 by an input voltage Vin after the completion of the self-bias period, the source of the first transistor T1 is made a third potential through the fifth transistor T5.

10 Claims, 4 Drawing Sheets

VOLTAGE CURRENT CONVERSION DEVICE AND LIGHT EMITTING DEVICE

BACKGROUND OF THE INVENTION

1. Field of the Invention

The present invention relates to a voltage current conversion device used in a light emitting device such as an exposing apparatus of an electrophotographing system and a display device, and in particular, it relates to a voltage current conversion device preferably disposed in a signal transfer channel for providing a video signal which is a voltage signal to each pixel as a current signal.

2. Related Background Art

As a light emitting device, a display device will be cited as an example. In recent years, in general, an organic electroluminescence (EL) display device, which is one of the Trendy flat display panels, includes a display device of the type in which luminous brightness of an organic EL element disposed in each pixel as a light emitting element is decided by a current value provided in a data signal source. In this type, a voltage current conversion device is disposed in the data signal source and a video signal which is a voltage signal is required to be converted into a current signal. As the voltage current conversion device, for example, its circuit constitution is illustrated in FIG. 9 of Japanese Patent Application Laid-Open No. 2002-40074.

In FIG. 3 is shown one example of the circuit constitution of the voltage current conversion device. In the drawing, reference characters T0 and T1 denote a n-type transistor, respectively, and reference character Vin denotes a voltage to be inputted, and reference character Iout denotes a current to be outputted from the circuit, and reference character V1 denotes a first potential, and reference character S1 denotes a control signal.

In the device of FIG. 3, the transistor T1 outputs a current Iout of the value corresponding to the gate voltage by a gate potential set by the voltage Vin which is inputted through the transistor T0 provided as occasion arsies.

However, in case the device of FIG. 3 is disposed in a plurality of data signal lines corresponding to a plurality of pixel columns, respectively, due to the irregularity of a threshold value Vth of the transistor T1, an irregularity occurs in the output current Iout for the input voltage Vin of the same level.

To solve such a problem, first, the present inventor invented a voltage current conversion device of the circuit constitution as shown in FIG. 4. In the drawing, reference characters T0 to T3 and T6 denote a n-type transistor, respectively, reference character T7 denotes a p-type transistor, reference characters S1 to S3 and S6 denote an independent control signal, respectively, reference characters C1 and C2 denotes capacitors, reference characters V1 and V3 denote potential sources (potential sources) providing first and third potentials, reference character Vin denotes an input terminal to be inputted with an input voltage, and reference character Iout denotes an output terminal from which an output current is outputted.

The operation of the device of FIG. 4 will be described by the timing chart of FIG. 5. In the drawing, VG(T1) shows a gate potential of the first transistor T1, and VS(T1) shows a source potential of the first transistor T1.

First, in a time t1, control signals S2 and S3 become a high level H, and the second transistor T2 and the third transistor T3 turn on. In this manner, the gate potential VG(T1) of the first transistor T1 is pre-charged by the first potential source V1.

Next, in a time t2, the control signal S3 of the gate of the third transistor T3 becomes a low level L, so that the third transistor T3 turns off and the first transistor T1 is applied with a self-bias toward a turn-on voltage, and discharges by drawing a gentle curve. In this manner, the VG(T1) discharges toward the third potential V3 until it becomes the threshold value Vth of the transistor T1 by taking a sufficient time. Here, Va'=Vth.

After the completion of the self-bias period, in a time t3, the control signal S2 becomes L, and the second transistor T2 turns off, and further, in a time t4, the control signal S1 becomes H, and the input control transistor T0 turns on. As a result, the gate of the first transistor T1 becomes a potential Vb'. Here, the Vb' is a sum of the threshold value Vth of the first transistor T1 and the capacitor split voltages Vc of C1 and C2 of the input voltage Vin. In a time t5, the control signal S1 becomes L and the input control transistor T0 turns off.

In an appropriate time subsequent to the time t5, the control signal S6 becomes H, and the sixth transistor T6 turns on as occasion arises, and the output current Iout corresponding to the gate potential VG(T1) of the first transistor T1 which is set at the time t4 to t5 through the sixth transistor T6 and the first transistor T1 is obtained.

The voltage current conversion device of FIG. 4 has no irregularity other than the threshold value Vth of the first transistor T1, and if a sufficient self-bias is applied, the conversion device is supposed to be able to obtain a voltage current conversion characteristic which does not have an irregularity among a plurality of voltage current conversion devices.

However, in the voltage current conversion device of FIG. 4, a charge Q injected to the gate of the first transistor T1 becomes C2×(Vpre−Vth). Here, Vpre shows a voltage pre-charged to the gate of the first transistor T1 through the transistors T2 and T3 which are turned on from the first potential V1. The charge Q must be discharged during the self-bias period of the times t2 to t3. In reality, since the discharging period is finite, the gate potential VG(T1) after the self-bias becomes Va'. Here, Va is a sum of the threshold value Vth of the first transistor T1 and a self-bias residual voltage Vr. Hence, citing the application to the display device as an example, even in case a black display is made in the EL element, the current corresponding to the self-bias residual voltage Vr ends up flowing into the pixel having the EL element. That is, the current supply to the pixel is completely shut off, and the black display is unable to be performed, thereby lowering a display contrast.

SUMMARY OF THE INVENTION

An object of the present invention is to provide a voltage current conversion device, in which an output current can be drawn as unlimitedly as possible to 0 in case a voltage current conversion characteristic is uniform, and an input voltage Vin is 0.

Another object of the present invention is to provide a voltage current conversion device, comprising:

a voltage/current conversion transistor comprising a gate for receiving a voltage signal inputted from an input terminal, a drain for outputting a current signal from an output terminal and a source;

a gate potential setting circuit for setting the gate of the voltage/current conversion transistor to a predetermined first potential; and a source potential setting circuit including a setting transistor for setting the source of the voltage/current conversion transistor to a predetermined second potential, wherein the second potential is different from the potential of the terminal coupled to the gate of the voltage/current conversion transistor through a storage capacitor.

According to the present invention, even in case the self-bias period of the voltage/current conversion transistor which decides an output current is a short period of time, the output current can be almost completely shut off for the zero setting of an input voltage. Consequently, even in case an element reacting to a micro current is current-driven, a definite operation stop of the element can be realized. Further, in case a plurality of voltage current conversion devices of the present invention are used in parallel in the display device and the like, an uniform voltage current conversion characteristic can be obtained without being affected by the irregularity of the threshold value of the transistor.

DETAILED DESCRIPTION OF THE PREFERRED EMBODIMENTS

Figure 1:
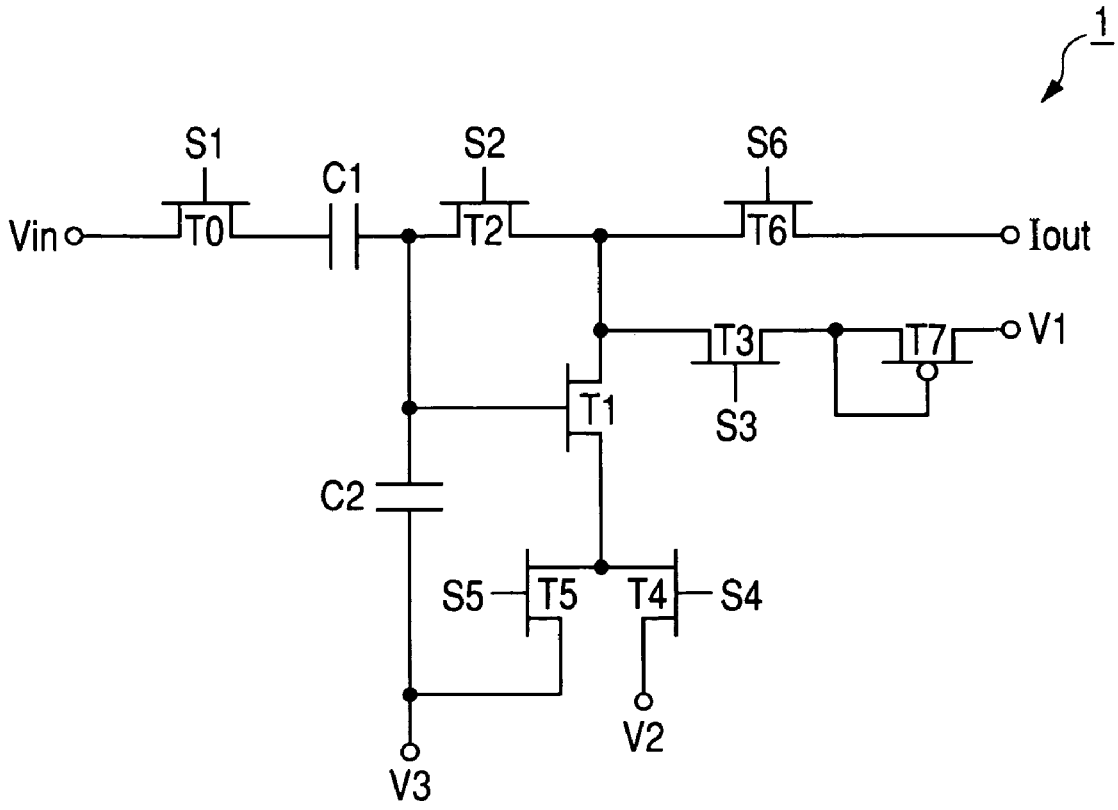
FIG. 1 is a view showing a circuit constitution of a first embodiment of a voltage current conversion device of the present invention.

A circuit constitution of a preferred embodiment of the voltage current conversion device of the present invention is shown in FIG. 1. In the drawing, reference characters T0 to T6 denote a n-type transistor, respectively, reference character T7 denote a p-type transistor, reference characters C1 and C2 denote first and second capacitors, respectively, reference characters S1 to S6 denote a independent control signal, respectively, reference characters V1 to V3 denote first to third potentials, which serves also as a potential source which supplies these potentials, reference character Vin denotes an input terminal to which an input voltage is applied, and reference character Iout denotes an output terminal to which an output current is supplied.

The voltage current conversion device of FIG. 1, comprising:

a voltage/current conversion transistor T1 comprising a gate for receiving a voltage signal inputted from an input terminal Vin, a drain for outputting a current signal from an output terminal Iout and a source;

gate potential setting circuits T2, T3 and T7 for setting the gate of the voltage/current conversion transistor T1 to a predetermined first potential V1; and source potential setting circuits V2, T4, T5 and V3 including a setting transistor T4 for setting the source of the voltage/current conversion transistor T1 to a predetermined second potential V2, wherein the second potential V2 is different from the potential V3 of the terminal coupled to the gate of the voltage/current conversion transistor T1 through a storage capacitor C2.

In the device of FIG. 1, the source potential setting circuit may preferably further include a transistor T5, which connects the terminal V3 and the source of the voltage/current conversion transistor T1.

Further, the gate potential setting circuit may preferably include a transistor T2, which connects the gate and the drain of the voltage/current conversion transistor T1.

Further, the source potential setting circuit may preferably allow the gate potential to be transferred up to a potential in which the gate potential of the voltage/current conversion transistor T1 set to the first potential V1 becomes smaller in its absolute value.

The device of the present embodiment comprises:

a first transistor in which a gate is connected to the other terminal of a first capacitor C1, where an input terminal Vin inputted with a voltage is connected to the one terminal, and the terminal of the second capacity, and a drain is connected to the output terminal from which a current is outputted, a second transistor T2 in which a source is connected to the other terminal of the first capacity C1 and the gate of the first transistor T1, and a drain is connected to the output terminal Iout, and a gate is controlled by an independent control signal S2, a third transistor T3 in which a source or a drain is connected to the drain of the first transistor T1, and the drain or the source is connected to a first potential V1, and a gate is controlled by an independent control signal S3, a fourth transistor T4 in which a drain is connected to the source of the first transistor T1 and a source is connected to a second potential V2, and a gate is controlled by an independent control signal S4, and a fifth transistor T5 in which a drain is connected to the source of the first transistor T1, and a source is connected to the other terminal of the second capacitor C2 and a third potential V3, and a gate is controlled by an independent control signal S5.

Here, the first, second and third potentials is preferably set so that a potential difference between the third potential and the second potential becomes equal to or more than the voltage remained in the gate potential after the self-bias of the first transistor.

Further, the third potential is preferably a common potential of the input voltage.

The first to fifth transistors are preferably a thin film transistor constituted by using a non-single crystal semiconductor.

As described above, in the embodiment of FIG. 1, the input control transistor T0 is disposed between the input terminal and the other terminal of the first capacitor C1 as occasion arises, and by the independent control signal S1, on and off of the transistor T0 are controlled, and the input timing of the input voltage Vin is controlled. Further, between the drain of the first transistor T1, the drain of the second transistor T2, and the output terminal, there is also disposed the sixth transistor T6 as occasion arises so as to control the output timing of the output current Iout, and this is controlled by the independent control signal S6.

Figure 4:
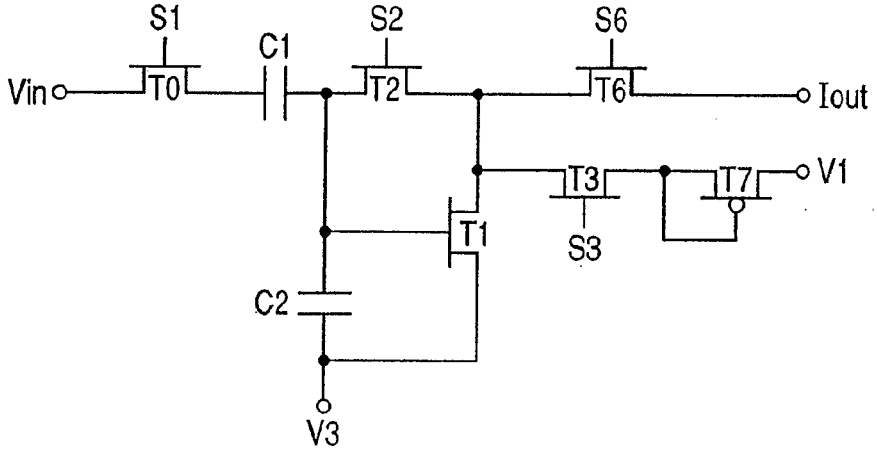
(PRIOR ART) FIG. 4
FIG. 4 is a view showing the circuit constitution of another example of the conventional voltage current conversion device.

The voltage current conversion device of FIG. 1 is different from the voltage current conversion device of FIG. 4 in that the fourth and fifth transistors T4 and T5 are provided, and the source potential of the first transistor (voltage/current conversion transistor) T1 in the self bias period is set to the second potential V2, and the second potential V2 is set lower than the third potential V3 so that "the third potential V3−the second potential V2" becomes equal to or more than the self-bias residual voltage Vr. In this manner, the effect of the self-bias residual voltage can be kept removed in advance. The third potential V3 may be taken as a common potential of the input voltage Vin.

Figure 2:
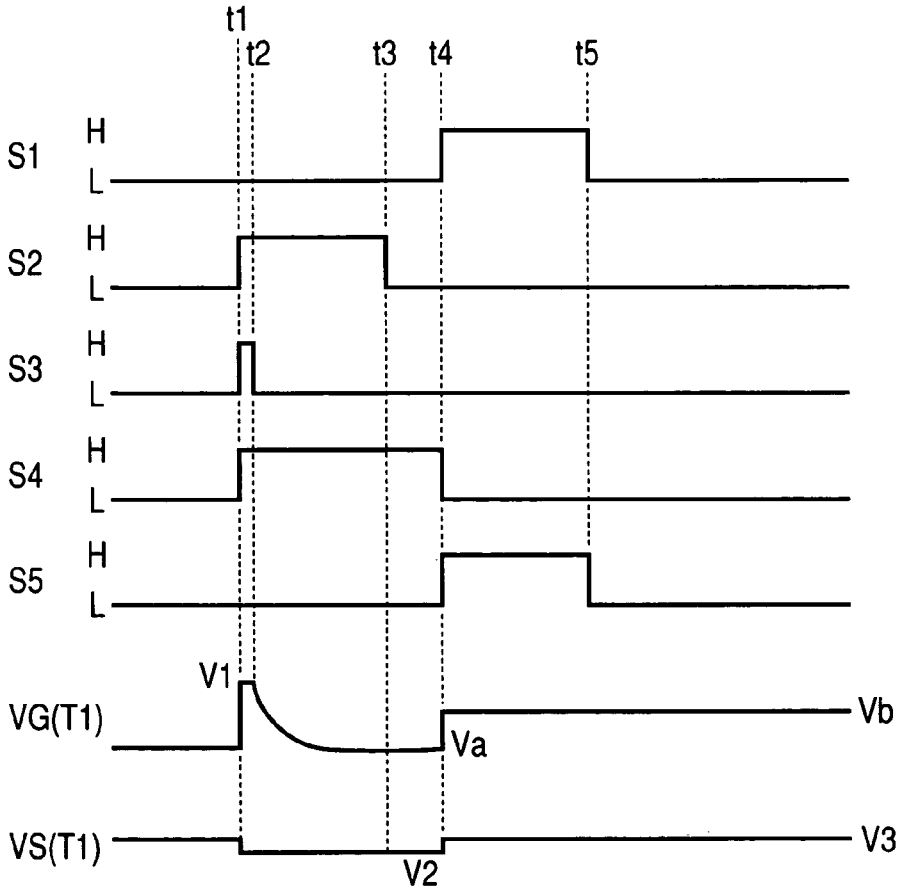
FIG. 2 is a timing chart of the voltage current conversion device of FIG. 1.
Figure 3:
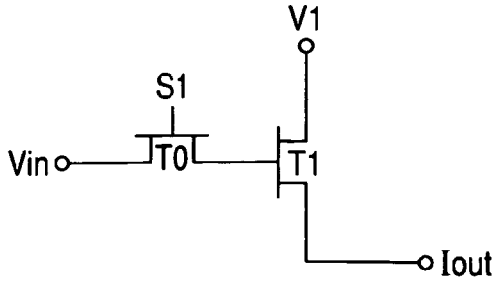
FIG. 3 PRIOR ART
FIG. 3 is a view showing the circuit constitution of one example of a conventional voltage current conversion device.

The operation of the device of FIG. 1 will be described below more specifically with reference to the timing chart of FIG. 2.

In the time t1, the control signals S2, S3 and S4 become a high level H, respectively, and the second, third, and fourth transistors T2, T3 and T4 turn on. In this manner, the source potential VS(T1) of the first transistor T1 is set to the second potential V2 trough the fourth transistor T4, and the gate potential VG(T1) is pre-charged by the first potential V1 through the second and third transistors T2 and T3, and becomes the potential V1.

Figure 5:
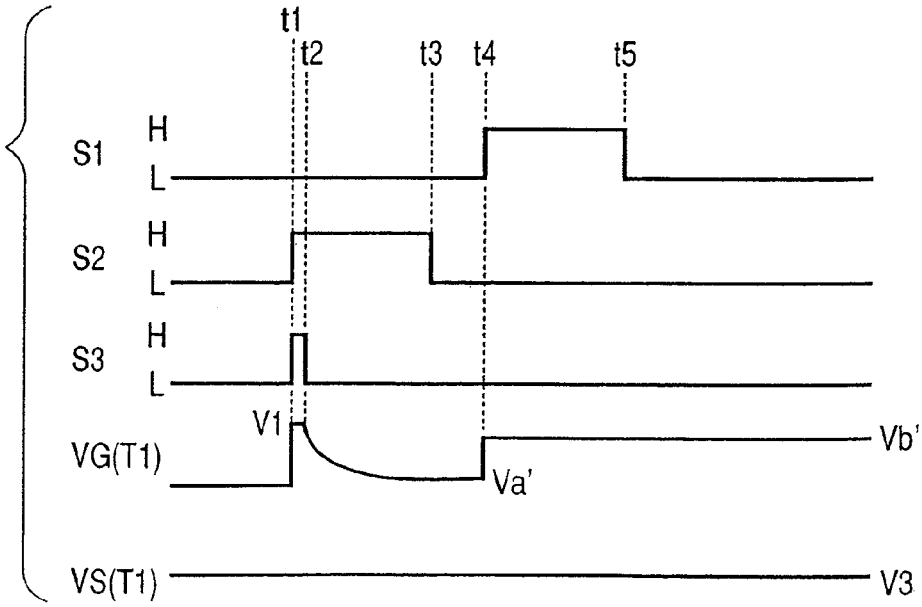
(PRIOR ART) FIG. 5
FIG. 5 is a timing chart of the voltage current conversion device of FIG. 4.
Figure 6:
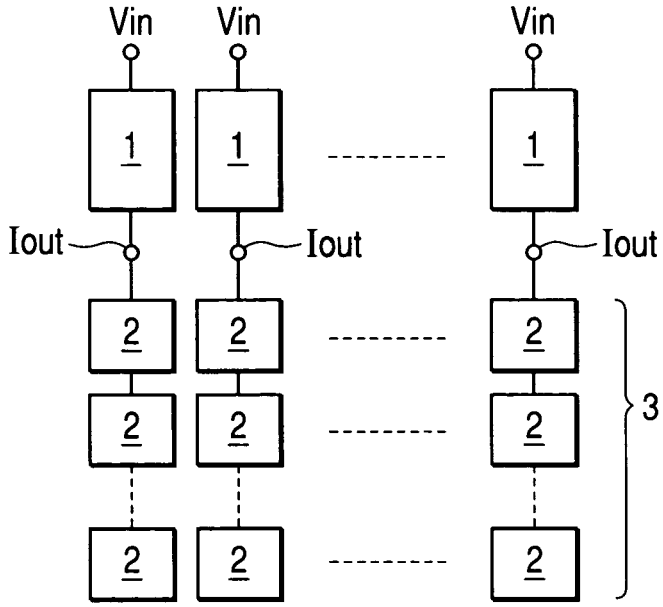
FIG. 6 is a view showing the constitution of an light emitting device.

Next, in the time t2, the control signal S3 becomes a low level L, and the third transistor T3, which constitutes a gate potential setting circuit, turns off. Then, the first transistor T1 is applied with the self-bias toward a turn on voltage, and the gate potential VG(T1) of the transistor T1 draws a gentle curve so as to perform a discharging operation. At this time, the source potential VS(T1) of the first transistor T1 is set to the second potential V2 by the source potential setting circuit. Hence, the gate potential VG(T1) of the first transistor T1 advances toward the second potential V2 until it becomes the threshold value Vth of the transistor T1, thereby performing the discharging of the charge in a short period of time comparing to FIGS. 4 and 5.

In the time t3, when S2 and S4 becomes L, the second and fourth transistors T2 and T4 turn off, and the discharge of the first transistor T1 completes. The gate potential at this time is sufficiently low, that is, it becomes a potential Va small in absolute value. Subsequently, in the time t4, when S1 and S5 become H, the input control transistor T0 and the fifth transistor T5 turn on, and the source potential VS(T1) of the first transistor T1 is set to the third potential V3, and at the same time, the gate potential VG(T1) becomes Vb. Here, "Vb=the threshold value Vth of the first transistor T1+the self bias residual voltage Vr−(the third potential V3−the second potential V2)+C1 and C2 capacitor split voltages of the input voltage Vin." In the time t5, the control signals S1 and S5 become L, and the input control transistor T0 and the first transistor T1 turn off. Subsequent to this time, when, in an appropriate time, the control signal S6 is allowed to become H and the sixth transistor T6 is allowed to turn on, the output current Iout corresponding to the gate potential VG(T1) of the first transistor T1 set in the times t4 to t5 is obtained through the sixth transistor T6 and the first transistor T1.

Consequently, in the above-described voltage current conversion device, in case the input voltage Vin is 0, the gate potential VG(T1) of the first transistor T1 becomes "the threshold value Vth of the first transistor T1+the self bias residual voltage Vr−(the third potential V3−the second potential V2)." Here, since the second potential V2, as described above, is set so that "the third potential V3−the second potential V2≧the self-bias residual voltage Va", the gate potential VG(T1) becomes lower than the threshold value Vth of the first transistor T1, and the first transistor T1 is sufficiently shut off.

As described above, in the voltage current conversion device of the present embodiment, when the second potential and the third potential are set to a predetermined relation according to the self bias period, the effect of the self-bias residual voltage at the time when the input voltage is zero is eliminated, and the output current can be made zero.

Further, a correction effect by the irregularity of the threshold value of the transistor in case of using a plurality of voltage current conversion devices of the present embodiment in parallel is the same as the voltage conversion device of FIG. 4, and can be maintained.

The voltage current conversion device of the present invention is preferably used in a display device, and hence, it is also preferably used in the case of a thin film transistor in which the first to fifth transistors are constituted by using a non single crystal semiconductor thin film such as a non crystal silicon.

The above described device can be adapted to the light emitting device comprising a light emitting portion 3 having a plurality of light emitting elements in the light emitting device and a signal source 1 for supplying a current signal to the light emitting portion 3, wherein the signal source 1 includes the voltage current conversion device of FIG. 1.

Here, the light emitting portion 3 is preferable to be an active matrix type organic EL light emitting display portion having a light emitting element and a transistor. The pixel circuit of the light emitting portion 3 is as follows.

Figure 7:
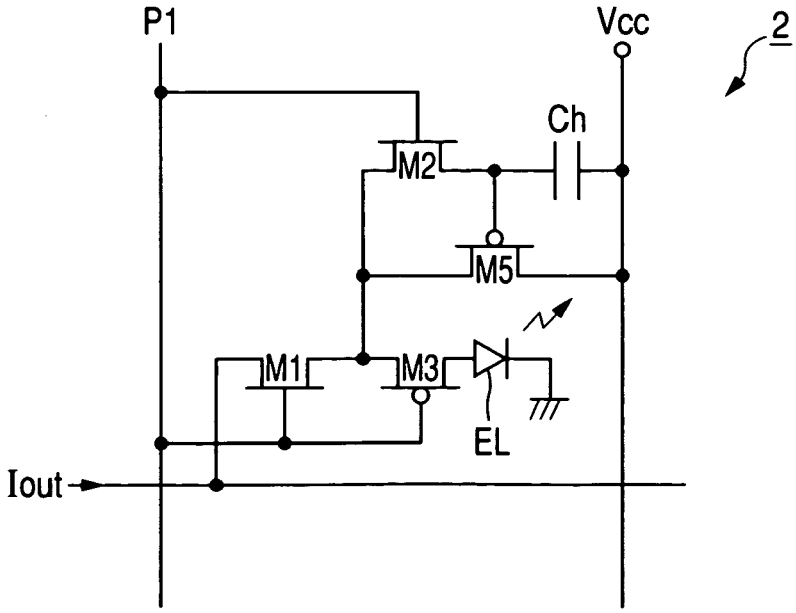
FIG. 7 is a view showing a pixel circuit of the light emitting device.

FIG. 7 shows a pixel circuit 2 comprising a light emitting element EL, a driving transistor M5, a current programming switching transistors M1 and M2, and a light emitting control switching transistor M3.

The transistors M1 and M2 are turned on, and the transistor M3 is turned off, and the current signal Iout is programmed to the pixel circuit 2. Subsequently, the transistors M1 and M2 are turned off, and the transistor M3 is turned on, and the current is let flow to the light emitting element EL from a power source line Vcc, so that the light emitting element EL is emitted. Reference character P1 is a scan control line.

This application claims priority from Japanese Patent Application No. 2004-109102 filed on Apr. 1, 2004, which is hereby incorporated by reference herein.

What is claimed is:

1. A voltage current conversion device, comprising:

a voltage/current conversion transistor having a gate for receiving a voltage signal inputted from an input terminal, a drain for outputting a current signal from an output terminal, and a source;

a gate potential setting circuit for setting said gate of the voltage/current conversion transistor to a predetermined first potential; and a source potential setting circuit including a setting transistor for setting said source of said voltage/current conversion transistor to a predetermined second potential, wherein said second potential is different from a potential of a terminal coupled to said gate of said voltage/current conversion transistor through a storage capacitor.

2. The voltage current conversion device according to claim 1, wherein said source potential setting circuit further includes a transistor to connect said terminal and said source of said voltage/current conversion transistor.

3. The voltage current conversion device according to claim 1, wherein said gate potential setting circuit includes a transistor to connect said gate and said drain of said voltage/current conversion transistor.

4. The voltage current conversion device according to claim 1, wherein said source potential setting circuit allows said gate potential to be transferred up to a potential in which said gate potential of said voltage/current conversion transistor set to said first potential becomes smaller in its absolute value.

5. A light emitting device comprising a light emitting portion having a plurality of light emitting elements in a light emitting device; and a signal source for supplying a current signal to said light emitting portion, wherein said signal source includes the voltage current conversion device according to claim 1.

6. The light emitting device according to claim 5, wherein said emitting portion is an organic EL light emitting display portion of an active matrix type having a light emitting element and a transistor.

7. A voltage current conversion device, comprising:

a first transistor in which a gate is connected to one terminal of a first capacitor, where an input terminal inputted with a voltage is connected to another terminal of said first capacitor, and a terminal of a second capacitor, and a drain is connected to an output terminal from which a current is outputted, a second transistor in which a source is connected to said one terminal of said first capacitor and the gate of the first transistor, and a drain is connected to said output terminal, and a gate is controlled by an independent control signal, a third transistor in which a source or a drain is connected to the drain of said first transistor, and the drain or the source is connected to a first potential, and a gate is controlled by an independent control signal, a fourth transistor in which a drain is connected to the source of said first transistor, and a source is connected to a second potential, and a gate is controlled by an independent control signal, and a fifth transistor in which a drain is connected to the source of said first transistor, and a source is connected to another terminal of said second capacitor and a third potential, and a gate is controlled by an independent control signal.

8. The voltage current conversion device according to claim 7, wherein said first, second and third potentials are set so that a potential difference between said third potential and said second potential becomes equal to or more than the voltage remained in the gate potential after the self bias of the first transistor.

9. The voltage current conversion device according to claim 7, wherein said third potential is a common potential of the input voltage.

10. The voltage current conversion device according to claim 7, wherein said first to fifth transistors are a thin film transistor constituted by using a non single crystal semiconductor.

* * * * *

UNITED STATES PATENT AND TRADEMARK OFFICE

CERTIFICATE OF CORRECTION

PATENT NO. : 7,342,560 B2
APPLICATION NO. : 11/092858
DATED : March 11, 2008
INVENTOR(S) : Yuki et al.

It is certified that error appears in the above-identified patent and that said Letters Patent is hereby corrected as shown below:

COLUMN 3:
Line 16, “an” should read -- a --;
Line 49, “denote” should read -- denotes --;
Line 51, “a independent” should read -- an independent --; and
Line 53, “serves” should read -- serve --.

COLUMN 4:
Line 45, “is” should read -- are --.

COLUMN 5:
Line 18, “trough” should read -- through --.

COLUMN 6:
Line 18, “above described” should read -- above-described --.

COLUMN 8:
Line 18, “self bias” should read -- self-bias --; and
Line 25, “non single” should read -- non-single --.

Signed and Sealed this

Twenty-third Day of September, 2008

JON W. DUDAS
*Director of the United States Patent and Trademark Office*